US006644983B2

(12) United States Patent
Recktenwald et al.

(10) Patent No.: US 6,644,983 B2
(45) Date of Patent: Nov. 11, 2003

(54) CONTACT ASSEMBLY, CONNECTOR ASSEMBLY UTILIZING SAME, AND ELECTRONIC ASSEMBLY

(75) Inventors: Willi Recktenwald, Holzgerlingen (DE); Gerhard Ruehle, Sindelfingen (DE); Rene Frank Schrottenholzer, Gaeufelden (DE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/050,275

(22) Filed: Jan. 16, 2002

(65) Prior Publication Data

US 2002/0111080 A1 Aug. 15, 2002

(30) Foreign Application Priority Data

Feb. 9, 2001 (EP) ..... 01103050

(51) Int. Cl.[7] ..... H01R 12/00
(52) U.S. Cl. ..... 439/75; 439/851
(58) Field of Search ..... 439/75, 74, 851

(56) References Cited

U.S. PATENT DOCUMENTS

| | | | | | |
|---|---|---|---|---|---|
| 3,862,792 | A | | 1/1975 | Jayne | 339/93 C |
| 3,915,537 | A | | 10/1975 | Harris et al. | 339/64 R |
| 4,296,993 | A | * | 10/1981 | Wellington | 439/876 |
| 4,906,198 | A | | 3/1990 | Cosimano et al. | 439/82 |
| 4,927,387 | A | | 5/1990 | Eckler et al. | 439/499 |
| 5,162,003 | A | | 11/1992 | Johnson et al. | 439/842 |
| 5,167,544 | A | | 12/1992 | Brinkman et al. | 439/856 |
| 5,189,261 | A | | 2/1993 | Alexander et al. | 174/263 |
| 5,280,414 | A | | 1/1994 | Davis et al. | 361/795 |
| 5,451,721 | A | | 9/1995 | Tsukada et al. | 174/261 |
| 5,561,322 | A | | 10/1996 | Wilson | 257/703 |
| 5,633,533 | A | | 5/1997 | Andros et al. | 257/707 |
| 5,728,606 | A | | 3/1998 | Laine et al. | 438/122 |
| 5,773,884 | A | | 6/1998 | Andros et al. | 257/707 |
| 5,798,563 | A | | 8/1998 | Feilchenfeld et al. | 257/668 |
| 5,825,630 | A | * | 10/1998 | Taylor et al. | 361/790 |
| 5,847,929 | A | | 12/1998 | Bernier et al. | 361/719 |
| 6,100,585 | A | * | 8/2000 | Chiba | 257/734 |
| 6,325,280 | B1 | * | 12/2001 | Murphy | 228/246 |

* cited by examiner

*Primary Examiner*—Renee Luebke
*Assistant Examiner*—Ann McCamey
(74) *Attorney, Agent, or Firm*—Lawrence R. Fraley; Arthur J. Samodovitz

(57) ABSTRACT

A contact assembly comprised of two parts bonded (e.g., welded) together, the first part including a male pin portion and the second part including a cylindrical jacket terminating in a flat end surface adapted for being electrically coupled (e.g., soldered) to a conductor (e.g., pad) on a substrate (e.g., PCB). Several contact assemblies may be positioned within a housing or substrate, to form a connector assembly which may then be positioned on and electrically coupled to a second substrate (e.g., a PCB), forming an electronic assembly.

13 Claims, 4 Drawing Sheets

CONTACT ASSEMBLY, CONNECTOR ASSEMBLY UTILIZING SAME, AND ELECTRONIC ASSEMBLY

FIELD OF THE INVENTION

The present invention in general relates to the mounting of electrical components on and within a substrate. More particularly, the invention relates to the mounting of such components on and within a printed circuit board (PCB). Still more specifically, the invention pertains to mounting such components having male pins or the like within a receiving contact or socket positioned within a substrate (e.g., a PCB structure) and adapted for being surface mounted on a separate PCB or the like.

BACKGROUND OF THE INVENTION

Electronic circuits have become so miniaturized to meet many of today's design requirements that the connector size relatively dwarfs the circuit it is connected to. The two major ways that electrical components (e.g., modules, resistors, capacitors, etc.) are attached to PCBs are to PCBs that have accommodating holes therein, and PCBs without such holes. Many PCB designs may include a combination of both. Such holes typically extend entirely through the PCB and are thus called "through holes" while others may only reach a predetermined depth within the PCB, and are called "blind holes" or "blind vias". An example of a PCB having both such holes is defined in U.S. Pat. No. 5,451,721 (Tsukada et al). In boards with holes (typically produced by drilling or punching), a component is inserted into the hole in the board. Such components typically include a pin or similar male projection (e.g., a resistor may include two opposing end wires of sufficient rigidity to enable direct hole insertion) and the component may be held in place by an interference fit, clinch, or a spring formed on a component pin (or leg). After all components are so positioned, these are subsequently soldered to the PCB. Various types of contacts (connectors) that can be positioned within a PCB or suitable insulative housing for mating with an also internally positioned pin or the like protruding contact are defined in the following U.S. Patents:

U.S. Pat. No. 3,862,792—Jayne

U.S. Pat. No. 3,915,537—Harris et al

U.S. Pat. No. 4,906,198—Cosimano et al

U.S. Pat. No. 4,927,387—Eckler et al

U.S. Pat. No. 5,162,003—Johnson et al

U.S. Pat. No. 5,167,544—Brinkman et al

U.S. Pat. No. 5,189,261—Alexander et al

The use of such pins and mating internal board contacts is referred to in the industry as pin-in-hole (PIH) technology.

In PCBs without holes, the components are typically surface mounted. In this case, the pads on the receiving board are printed with solder (usually paste) and the components are placed on these solder pads. The solder is then reflowed. The great advantage in surface mount is that there is a potential real estate board savings of up to 70% of the area of the board. The surface positioning of such components on PCBs is referred to in the industry as surface mount technology (SMT).

Mounting components on the surface of a PCB usually involves the application of a highly viscous solder alloy (typically, by silk-screening methodology) to various solder joint locations on the flat surface of the PCB. The solder paste will retain the loaded components in their correct position up through the soldering process. Reflow soldering—where the PCB carrying the loaded components and the solder paste is baked in an elevated temperature chamber—is achieved when the joint temperatures reach a predetermined temperature, usually about 250° C. The solder paste liquifies and coats the solder contacts of the respective parts and the PCB's solder pad. Thereafter, cooling of the assembly causes solidification of the solder, and electrical and mechanical bonding of the surface mounted component to the PCB is completed.

Examples of assemblies in which an electrical component is surface mounted on a PCB or the like substrate are defined in the following U.S. Patents:

U.S. Pat. No. 5,280,414—Davis et al

U.S. Pat. No. 5,561,322—Wilson

U.S. Pat. No. 5,633,533—Andros et al

U.S. Pat. No. 5,728,606—Laine et al

U.S. Pat. No. 5,773,884—Andros et al

U.S. Pat. No. 5,798,563—Feilchenfeld et al

An example of an assembly which defines the use of pins to mount a component into a PCB while also defining the use of solder to mount a component (here, a chip) onto a substrate is defined in U.S. Pat. No. 5,847,929 (Bernier et al).

For some PIH mounting (soldering) applications, so called "Miniature One-Piece Contacts" are on the market. An example is shown in FIG. 2. These contacts were developed from earlier "Two Piece PGA Contacts", designed for PGA (pin grid array) sockets with a small contact distance, e.g., smaller than 1.27 mm (50 mil). Such "Miniature One-Piece Contacts" are intended for the realization of a 1 mm high-terminal contact field and have a greater lateral isolation distance to the pluggable partner than their predecessors. These contacts are therefore more forgiving to mechanical tolerances. Said "Miniature One-Piece Contacts" (as seen in FIG. 2) can be arranged in a two-dimensional array held within an insulative housing. However, limits are set to the direct application of "Miniature One-Piece Contacts" in PIH implementation, so that using SMT is usually preferred. In addition, SMT implementation is an alternative as a detachable connecting element for existing SMT modules (solderball/soldercolumn). By the term "contact member" as used herein is meant to define an electrically conductive article adapted for being electrically connected to two separate electrical conductors such as PCB pads, male conductive pins, internally plated PCB through holes or vias, etc. When such a contact member is combined with a pinned element (e.g., the pin is inserted therein), the term "contact assembly" is used. Such an assembly, as explained hereinbelow, may be adapted for being positioned within an insulative housing, substrate or PCB and in turn directly electrically coupled to a second housing, substrate or PCB.

Due to the increasing demand for miniaturization in products such as those mentioned above, there are limits (because of hole, bore and clearance diameters and tolerances) when using even more recent plated-through-hole (PTH) technology. Plated through holes are understood to be through holes in the PCB with appropriate internal plating (e.g., copper) for coupling to internally positioned components and/or internal conductive planes. One limiting factor here is, among other things, the distance useable for the conductors between two adjacent PTHs, which distance may also be defined as the channel width. In the case of multilayer-PCBs (boards having several conductor and insulative layers stacked on one another), useable channel width is additionally narrowed due to registration tolerances when laminating the different planar conductive and insulative layers.

Although contacts for PIH and for SMT utilization having separate sleeve and contact springs are known including contacts of one-piece construction, it is believed that a new and unique contact member and assembly adapted especially for surface mount use while also providing pin accommodation would constitute an advancement in the art.

OBJECTS AND SUMMARY OF THE INVENTION

It is, therefore, an object of the present invention to provide a new and improved contact member for use in PCB surface mounting applications.

It is a further object of the invention to provide such a contact member which, when combined with another pinned contact member, will include both sleeve and spring features. As stated, such a combination will be referred to herein as a contact assembly.

It is still a further object of the present invention to provide such a contact member and assembly which is of relatively simple construction and which can be readily produced using mass production, thus resulting in a reduced cost final product.

According to one aspect of the invention, there is provided a contact assembly comprising a first contact member including a sleeve portion and a male pin portion, the first contact member adapted for being positioned within a dielectric substrate or housing, and a second contact member fixedly secured to the male pin portion of the first contact member and including a substantially flat end surface adapted for being soldered onto an electrical conductor.

According to another aspect of the invention, there is provided a connector assembly comprising an insulative substrate or housing, a plurality of contact assemblies positioned within the insulative substrate or housing, each of the contact assemblies including a first contact member securedly positioned within the insulative substrate or housing and including a sleeve portion and a male pin portion, and a second contact member fixedly secured to the male pin portion of the first contact member and including a substantially flat end surface adapted for being soldered onto an electrical conductor.

According to yet another aspect of the invention, there is provided an electronic assembly comprising a first substrate, a connector assembly positioned on the first substrate and electrically coupled thereto, the connector assembly including an insulative second substrate or housing and a plurality of contact assemblies positioned within the second substrate or housing. Each of the contact assemblies includes a first contact member securedly positioned within the insulative substrate or housing and including a sleeve portion and a male pin portion, and a second contact member fixedly secured to the male pin portion of the first contact member and including a substantially flat end surface adapted for being soldered onto an electrical conductor of the first substrate.

According to still another aspect of the invention, there is provided a method for making a contact assembly comprising the steps of providing a first contact member including a sleeve portion and a male pin portion, providing a second contact member including a substantially flat end surface, and soldering the second contact member onto the male pin portion of the first contact member.

BEST MODE FOR CARRYING OUT THE INVENTION

Figure 1:
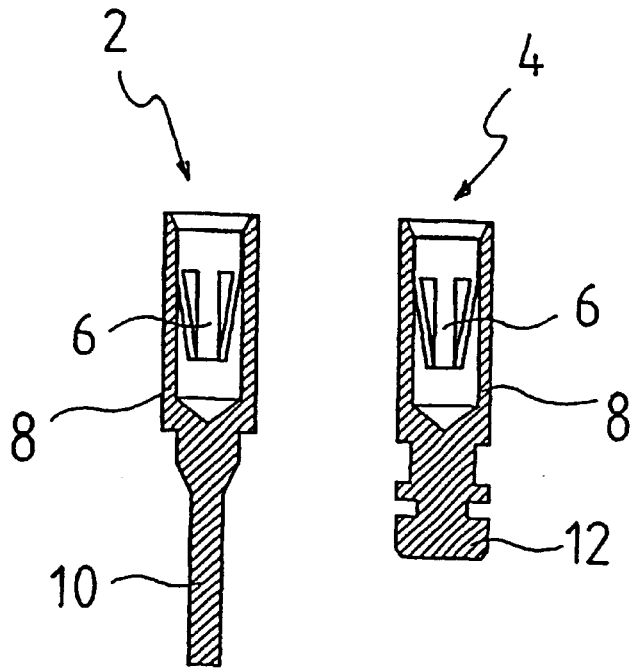
FIG. 1 (PRIOR ART)
FIG. 1 shows a known PIH contact and a surface mount PGA contact adjacent thereto.

FIG. 1 shows a PIH contact and a surface mount PGA contact 4, known in the art. These contacts 2 and 4 each include an internal spring 6 which is arranged within a surrounding sleeve 8. The PIH contact 2 has an elongated male part 10 (a pin) for insertion into a respective hole (e.g., a PTH) present within a PCB or similar substrate. Instead of a male pin, surface mount PGA contact 4 includes a flattened part 12, by means of which contact 4 may be soldered to a corresponding flat pad on the PCB.

Figure 2:
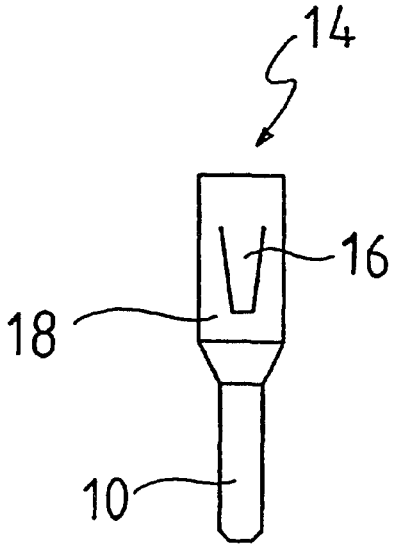
FIG. 2 (PRIOR ART)
FIG. 2 shows a known PIH "Miniature One-Piece Contact" mentioned hereinabove.

The "Miniature One-Piece Contact" 14 shown in FIG. 2 consists of one integral part, i.e., an external contact spring 16 which forms an integral part of hollow sleeve 18, which in turn has the projecting male pin 10 extending therefrom. Spring 16 is punched or stamped outwardly from sleeve 18, and is not, therefore, a separate element, unlike the contacts 2 and 4. Spring 6 is thus an integral part of sleeve 18. Due to the fact that no separate sleeve is present, the sleeve diameter of "Miniature One-Piece Contact" 14 is about 0.1 to 0.2 mm smaller than those of the contacts shown in FIG. 1, where spring 6 is a separate element that is press-fitted into sleeve 8. Thus, the distance between two adjacent contacts 14, when looking at the same grid, is about the same or greater than between pairs of contacts 2 or 4. This has the advantage that the electrical coupling between contacts 14 results in a higher isolating resistance. When doing without the mentioned advantages, the contacts could be packed more dense and more forgiving of mechanical tolerances.

Figure 3:
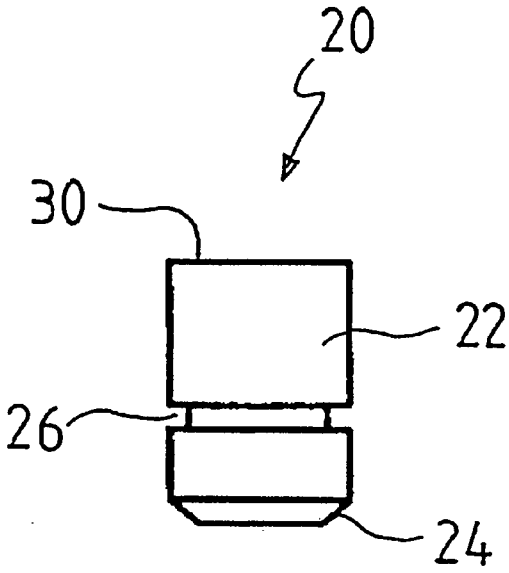
FIG. 3 depicts a contact member according to one embodiment of the present invention.
Figure 4:
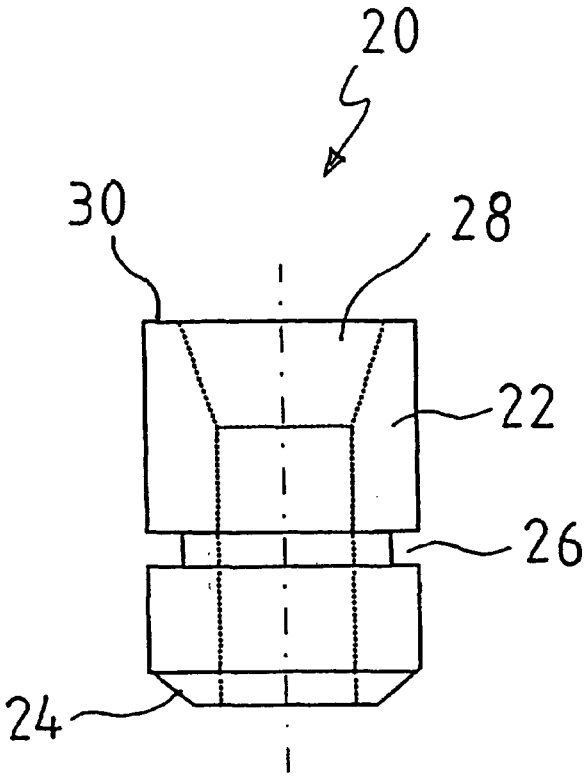
FIG. 4 is an enlarged view of the contact member of FIG. 3, in cross-section.
Figure 6:
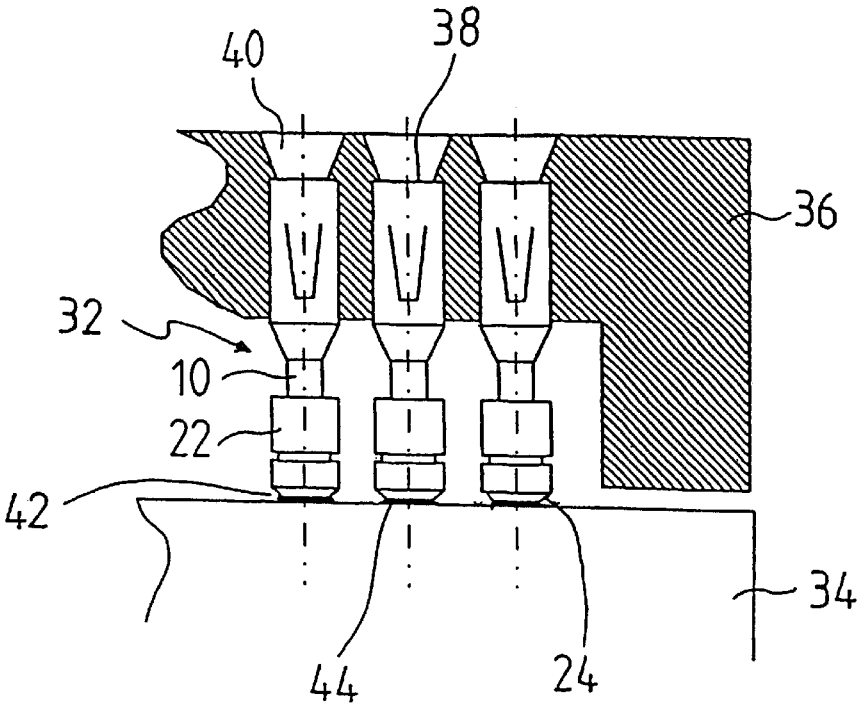
FIG. 6 schematically depicts the positioning of three adjacent contact assemblies according to one embodiment of the invention in which these assemblies are located within a corresponding dielectric or substrate housing such as a connector housing or PCB.
Figure 7:
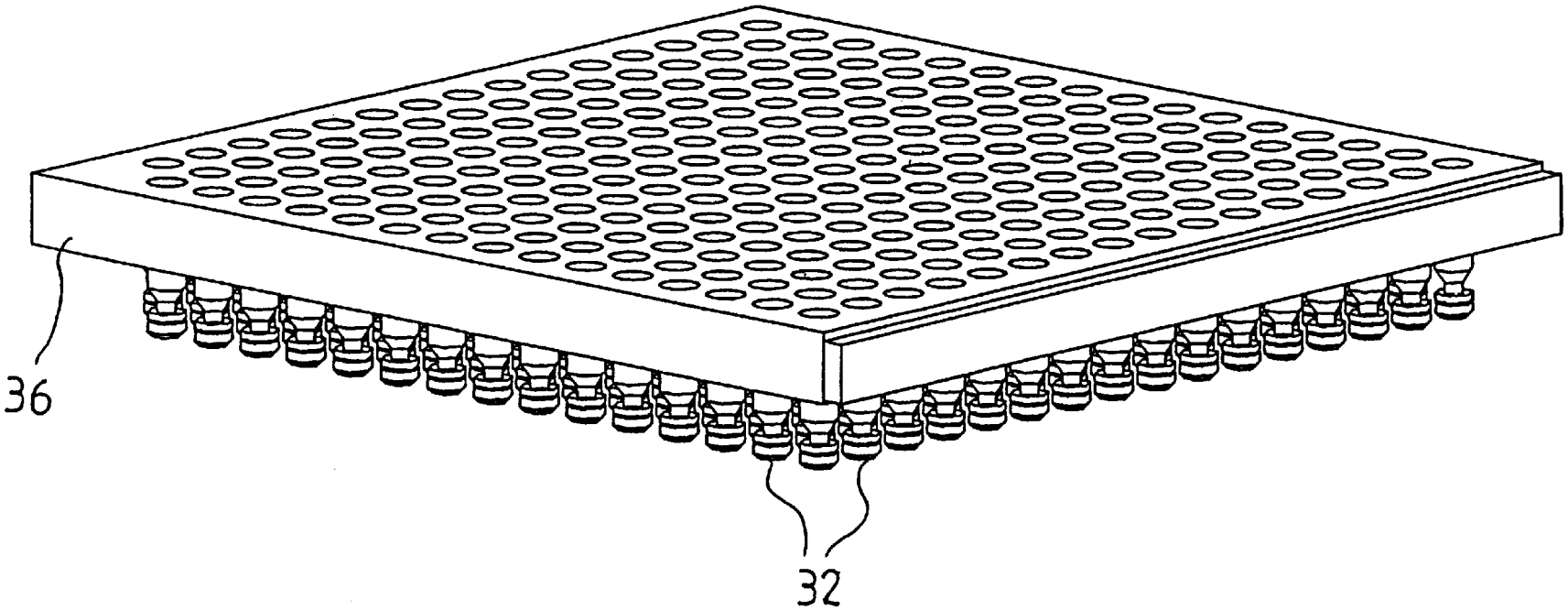
FIG. 7 schematically shows a connector assembly in which several of the contact assemblies shown in FIGS. 5 and 6 are utilized, the connector assembly including an insulative housing or substrate (including a PCB) having said assemblies positioned therein in an established pattern.

FIG. 3 shows a contact member 20 for the conversion of a pin-in-hole miniature one-piece contact (such as contact 14) to a miniature one-piece contact for surface mounting. Contact member 20 comprises a jacket 22, preferably of cylindrical shape, which is provided with a bevelled (tapered) base 24, also having a cylindrical shape. That is, contact member 20 has a flat end surface which further includes tapered side surfaces, both end surface and tapered sides forming the contact member's base portion. As seen in FIG. 6, the flat end surface rests atop a conductor (not shown) of the underlying substrate (e.g., PCB) 34, the surface then electrically coupled to the conductor by solder. PCBs are known to include many various conductors on the external surfaces thereof and further description is not believed necessary. As see in FIG. 4, a circumferential notch or groove 26 is arranged within the cylindrical jacket. In the center of contact member 20 there is a concentric bore (or opening) 28 which may include a conically shaped portion in the upper end of jacket 22 in the direction toward upper, opposite surface 30. Contact member 20 may be machined, e.g., formed by turning on a lathe or the like.

The tapered base portion 24 of contact member 20 enables the formation of a solder valley 42 (FIG. 6) between the jacket 22 and the upper surface of a PCB 34 on which the connector assembly (housing/PCB 36 and contact assemblies 32) of the invention is positioned. The notch or groove 26 provides a soldering stop for any ascending solder during the soldering of contact member 20 onto a respective pad of PCB 34. The upper tapered portion of bore 28 facilitates placement therein of an elongated pin part 10 of a PIH contact, such as the one shown in FIG. 2.

Figure 5:
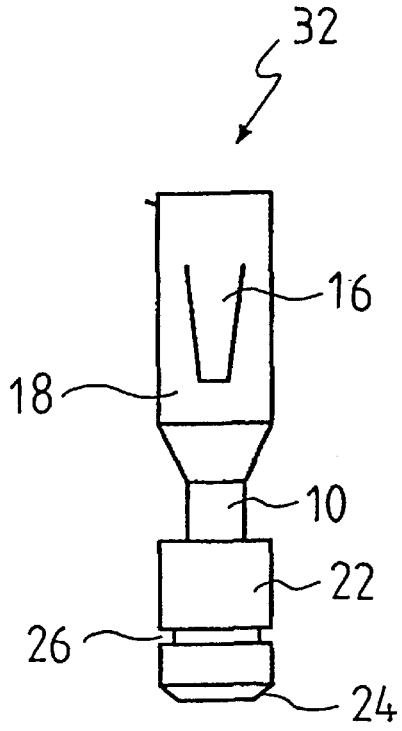
FIG. 5 shows a contact assembly according to one embodiment of the invention.

Contact member 20 is permanently bonded (e.g., soldered or welded) to male part 10 of contact 14 before further processing or use in a larger electronic structure. Member 20 is, therefore, now a single part structure. The completed contact assembly 32 is shown in FIG. 5. With the resulting component forming a single part structure, contact members 14 and 20 can now be referred to as portions of the completed unit.

It must be noted that the diameter of jacket 22 of member (portion) 20 should not exceed the outer diameter of the corresponding cylindrical sleeve (i.e., 18 in FIG. 2) of the PIH contact (i.e., 14) which is inserted therein so that the resulting contact assembly can be used in existing insulative connector housings 36 (FIG. 6) and the like, including substrates such as PCBs and those boards used in smaller ball grid array (BGA) package assemblies.

FIG. 6 illustrates a plurality of contact assemblies 32 arranged in a housing 36 which in turn is adapted for being positioned on a substrate 34 such as a PCB. As part of such positioning, each base 24 is soldered with solder 44 to the flat surface of a pad (not shown) of PCB 34. Upper surface pads on PCBs are very well known, and further description is unnecessary. See, e.g., conductor 42 in the aforementioned U.S. Pat. No. 5,280,414. The upper surface 38 of each contact assembly 32 is exposed through provided openings 40 of housing 36, forming leading-in conical openings positioned exactly above each assembly 32, where, in turn, pluggable pins of passive or active components, such as chip modules, may be mounted. Pins such as those shown in FIGS. 1 and 2 may also be inserted. (It is fully understood that the upper sleeve 18 of contact assembly 32 is hollow, thus including an internally positioned cylindrical opening in which such pins can be inserted.) As seen in FIG. 6, each assembly 32 is positioned within dielectric substrate (e.g., a PCB) or housing 36 in such a manner that the integral springs 16 frictionally engage the substrate's or housing's internal sidewalls (those defining the respective holes or openings into which each assembly 32 is inserted).

Some known processor modules have a 1 mm grid electrical connecting plane relative to the receiving PCB (package backplane). Contact is made by pressing electrically conducting elements oriented between the module and PCB. This connecting technique has proven to have some problems.

By means of the present invention as defined herein, contact members and assemblies can be produced and integrated into existing fabrication processes and products without having to extensively alter part dimensions. As understood from the teachings herein, such integration is achieved by fixing (e.g., by soldering) a contact member onto a corresponding contact (e.g., a Miniature One-Piece Contact) and then soldering this assembly onto the backpanel or other PCB. The presence of such assemblies in a suitable housing will thus also enable pinned or similar components to be positioned therein.

Thus, the present invention provides an efficient method of making a one-piece contact assembly suitable for surface mounting. This is accomplished by mounting a separate (and low cost) contact piece on the pin part of a miniature contact to provide a relatively larger bottom area for being effectively soldered to the surface of a PCB.

What is claimed is:

1. An electron assembly comprising:

a first substrate;

a second substrate with an electrical pad on a surface of said second substrate;

a connector assembly comprising:

a first contact having a first sleeve portion secured within a hole in said first substrate, said first contact having a pin portion integral with said first sleeve portion and protruding from said first sleeve portion external to said first substrate, said pin portion being designed to insert in a hole in a printed circuit board;

a second contact having a second sleeve portion and an end portion integral with said sleeve portion, said pin portion being soldered or welded within said second sleeve portion, said end portion having a flat surface in a plane perpendicular to said pin portion and a tapered perimeter region around said flat surface leading outwardly to said second sleeve portion, said end portion being surface-mount soldered to said electrical pad on said surface of said second substrate, and wherein said second contact is free standing other than its soldered or welded connection to said pin portion and its solder connection to said electrical pad.

2. An electronic assembly as set forth in claim 1 wherein said second sleeve portion includes an annular recess located between said tapered perimeter region and another end of said second contact that receives said pin portion, said annular recess being open and sized to receive solder wicking up said second sleeve portion from said surface-mount solder connection.

3. An electronic assembly as set forth in claim 1 wherein said second sleeve portion is not designed to be secured in a hole.

4. An electronic assembly as set forth in claim 1 wherein said second substrate is a printed circuit board.

5. An electronic assembly as set forth in claim 1 wherein said first substrate includes a cylindrical hole extending from one surface partially, but not completely through said first substrate, said first sleeve portion extending into said cylindrical hole from said one surface partially but not completely through said first substrate, an outer diameter of said first sleeve portion being approximately the same as an inner diameter of said cylindrical hole, said first substrate including a conical hole tapering from an opposite surface of said first substrate to said cylindrical hole to guide a second pin into said longitudinal hole and into said first sleeve portion, said first contact not having any portion above said first sleeve portion.

6. An electronic assembly as set forth in claim 1 wherein said second contact has substantially uniform outer diameter along substantially all its length except for said tapered perimeter region at said end of said second contact and an annular recess between said end and an opposite end of said second contact.

7. An electronic assembly as set forth in claim 1 wherein said first substrate is part of a housing.

8. An electronic assembly as set forth in claim 1 wherein said second contact includes a mounting hole to receive said pin portion.

9. An electronic assembly as set forth in claim 8 wherein said second contact also includes a funnel shaped hole leading to said mounting hole, said funnel shaped hole facilitating insertion of said pin portion into said mounting hole prior to soldering or welding said pin portion within said second contact.

10. An electronic assembly as set forth in claim 1 wherein said first sleeve portion includes a spring to frictionally engage another pin inserted into said first sleeve portion.

11. An electronic assembly as set forth in claim 10 wherein said spring in said first sleeve portion is an integral part of said first sleeve portion.

12. An electronic assembly as set forth in claim 1 wherein there are a multiplicity of electrical pads on said surface of said second substrate, and there are a multiplicity of said connector assemblies which interconnect said first substrate to said multiplicity of electrical pads on said surface of said second substrate.

13. An electronic assembly comprising:

a first substrate;

a second substrate with an electrical pad on a surface of said second substrate;

a connector assembly comprising:

a first contact having a first sleeve portion secured within a hole in said first substrate, said first contact having a pin portion integral with said first sleeve portion and protruding from said first sleeve portion external to said first substrate; and a second contact having a second sleeve portion and an end portion integral with said sleeve portion, said pin portion being soldered or welded within said second sleeve portion, said end portion having a flat surface in a plane perpendicular to said pin portion and a tapered perimeter region around said flat surface leading outwardly to said second sleeve portion, said end portion being surface-mount soldered to said electrical pad on said surface of said second substrate, and wherein said second contact is free standing other than its soldered or welded connection to said pin portion and its solder connection to said electrical pad.

* * * * *